US007470222B1

(12) United States Patent
Mkrtchyan

(10) Patent No.: US 7,470,222 B1
(45) Date of Patent: Dec. 30, 2008

(54) MUSCLE BUILDING TOOL

(76) Inventor: Rafik Mkrtchyan, 1135 Linden Ave., Glendale, CA (US) 91201

( * ) Notice: Subject to any disclaimer, the term of this patent is extended or adjusted under 35 U.S.C. 154(b) by 564 days.

(21) Appl. No.: 10/861,538

(22) Filed: Jun. 4, 2004

(51) Int. Cl.
*A63B 21/22* (2006.01)
*A63H 1/00* (2006.01)

(52) U.S. Cl. ..... 482/110; 446/236

(58) Field of Classification Search ..... 482/110–111, 482/92; 446/46–48, 242, 236
See application file for complete search history.

(56) References Cited

U.S. PATENT DOCUMENTS

| | | | | |
|---|---|---|---|---|
| 2,676,802 | A * | 4/1954 | O'Brien | 482/106 |
| 3,178,851 | A * | 4/1965 | Gage | 446/28 |
| 3,575,414 | A * | 4/1971 | O'Brien | 473/514 |
| 3,606,314 | A | 9/1971 | Popp | 272/57 |
| 4,221,074 | A * | 9/1980 | Gonzalez | 446/28 |
| 4,337,593 | A * | 7/1982 | McAllister | 446/236 |
| 4,714,246 | A | 12/1987 | Parisien | 272/93 |
| 4,730,827 | A | 3/1988 | Williams | 272/68 |
| 4,838,542 | A | 6/1989 | Wilkinson | 272/67 |
| 5,256,127 | A | 10/1993 | Yeh | 482/146 |
| 5,372,558 | A | 12/1994 | Perry | 482/49 |
| 5,921,902 | A | 7/1999 | Carpenter | 482/139 |
| 5,934,966 | A * | 8/1999 | Ward | 446/46 |
| 6,482,138 | B1 | 11/2002 | Nelson | 482/118 |
| 6,776,742 | B2 * | 8/2004 | Domenge | 482/110 |
| 2003/0190999 | A1 * | 10/2003 | Liu | 482/92 |

* cited by examiner

*Primary Examiner*—Fenn C Mathew
(74) *Attorney, Agent, or Firm*—Goldstein Law Offices, P.C.

(57) ABSTRACT

A muscle building tool for providing an effective upper body workout. The present invention includes a circular ring having substantially planar upper and lower surfaces, and a handle portion that extends perpendicularly from the circular ring. The handle portion is held within a hand of the user and is rotated to exercise the muscles of the user.

1 Claim, 4 Drawing Sheets

MUSCLE BUILDING TOOL

BACKGROUND OF THE INVENTION

The invention relates to a muscle building tool for providing an effective upper body workout.

Being physically active is one of the most effective tools in increasing the health of the mind, body and spirit. Reducing the risk of heart disease and stroke is effected by physical activity which also helps to lower or control other risk factors, such as high blood pressure, high blood cholesterol, excess body weight, and diabetes. A regular exercise regiment also makes one look and feel better, become stronger and more flexible, have more energy, and reduce stress and tension. Even though the majority of Americans are aware of the physical and mental benefits afforded by regular exercise, many who wish to engage in such an endeavor encounter daunting obstacles. For some, there is simply no time left in the day to set aside a small amount of time to perform any exercise activity. Trips to the local gym are practically impossible for those on tight schedules.

U.S. Pat. No. 4,714,246 to Parisien discloses an exercise device. U.S. Pat. No. 4,730,827 to Williams discloses a hand rehabilitation device. U.S. Pat. No. 4,838,542 to Wilkinson discloses a wrist exercise device. U.S. Pat. No. 5,256,127 to Yeh discloses an amusement twister equipped with sound reproducer. U.S. Pat. No. 5,372,558 to Perry et al. discloses an exercise devices. U.S. Pat. No. 5,921,902 to Carpenter discloses an adjustable handlebar for exercise equipment. U.S. Pat. No. 3,606,314 to Popp discloses a magnetic teaching game. U.S. Pat. No. 6,482,138 to Nelson discloses a rotational friction exercise device selectively attached to a support surface.

While these units may be suitable for the particular purpose employed, or for general use, they would not be as suitable for the purposes of the present invention as disclosed hereafter.

SUMMARY OF THE INVENTION

It is an object of the invention to produce a muscle building tool for providing an effective upper body workout. Accordingly, the present invention facilitates the user in performing a wide variety of exercises.

It is a further object of the present invention to provide a muscle building tool that is portable. Accordingly, the muscle building tool is compact, lightweight, and can be used anywhere.

The present invention is essentially comprised of a muscle building tool for providing an effective upper body workout.

The present invention includes a circular ring and a handle portion that is rotatably coupled with the circular ring. The tool is preferably provided in pairs, such that each handle portion is held in one of the hands, such that exercises can be performed with both hands simultaneously.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
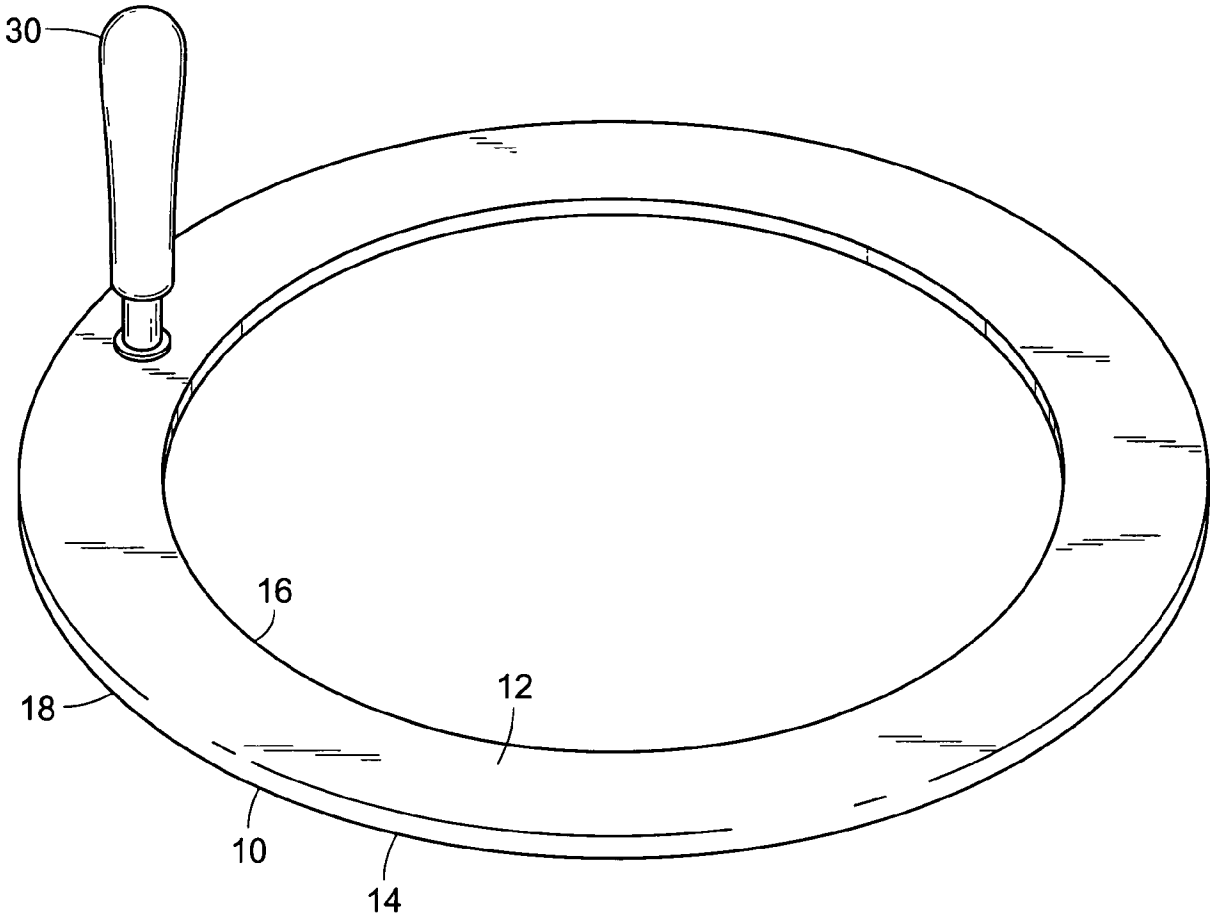
FIG. 1 is a perspective view of the preferred embodiment of the present invention.

FIG. 1 illustrates a muscle building tool for providing an effective upper body workout The present invention is essentially comprised of a circular ring 10 and a handle portion 30.

The circular ring 10 has a planar upper surface 12 and a planar lower surface 14. The circular ring 10 has an inner edge 16 and an outer edge 18. The circular ring 10 has an aperture 20 extending between the upper surface 12 and lower surface, located midway between the inner edge 16 and outer edge 18 thereof.

Figure 2:
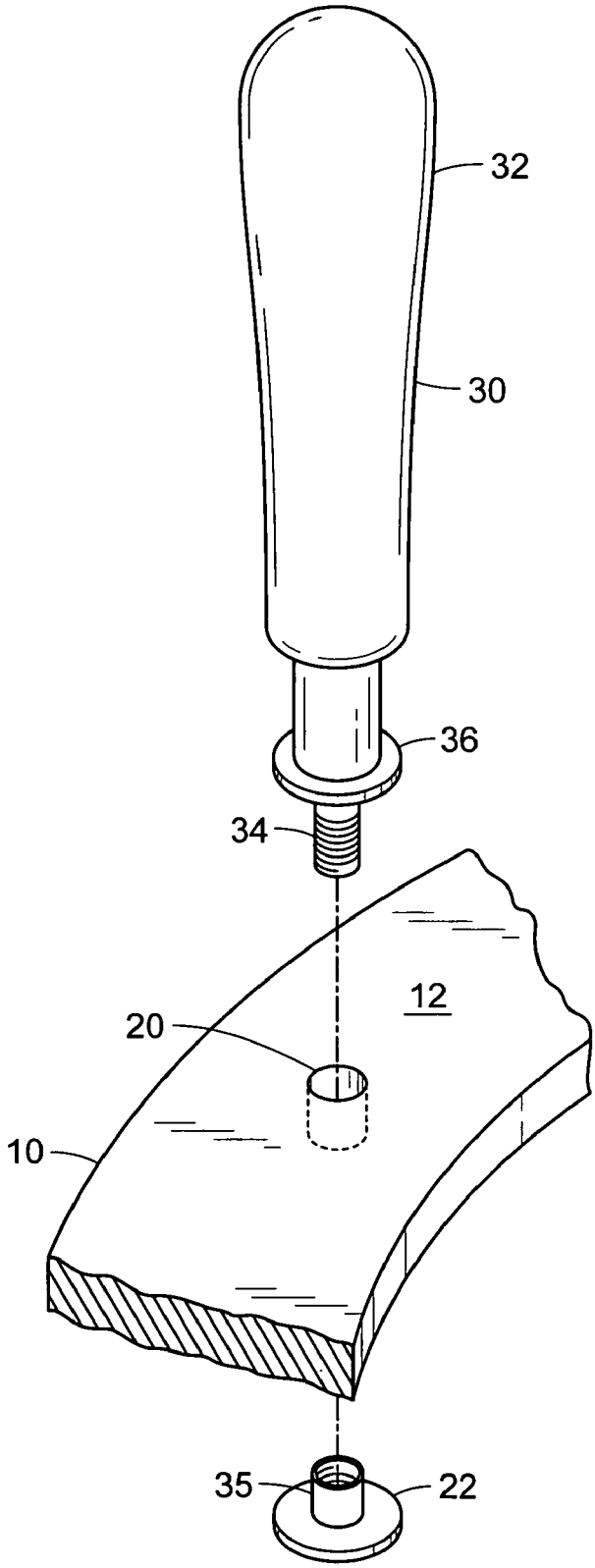
FIG. 2 is a perspective view illustrating the handle portion as securable to the circular ring.

The handle portion 30, as best illustrated in FIG. 2, rotatably couples with the circular ring 10 and extends perpendicularly from the planar upper surface 12. The handle portion 30 has an enlarged gripping portion 32 and a neck 34. The gripping portion 32 and the neck 34 are separated by a flange 36. The neck 34 is externally threaded and is selectively extendable through the aperture 20 in the circular ring 10 from the upper surface 12 to couple with the internally threaded nut 22 extending from the lower surface 14. When the neck 34 is extended through the aperture 20 and mated with the threaded nut 22, the flange ring rests against the upper surface 12. The internally threaded nut 22 has a cylindrical outer surface 35 that extends through the aperture 20 so that the handle 30 can rotate within the aperture. The fit and relative friction between the internally threaded nut 22 and the aperture 20 can be used to determine if and how easily the handle 30 can rotate within the aperture 20.

Figure 3:
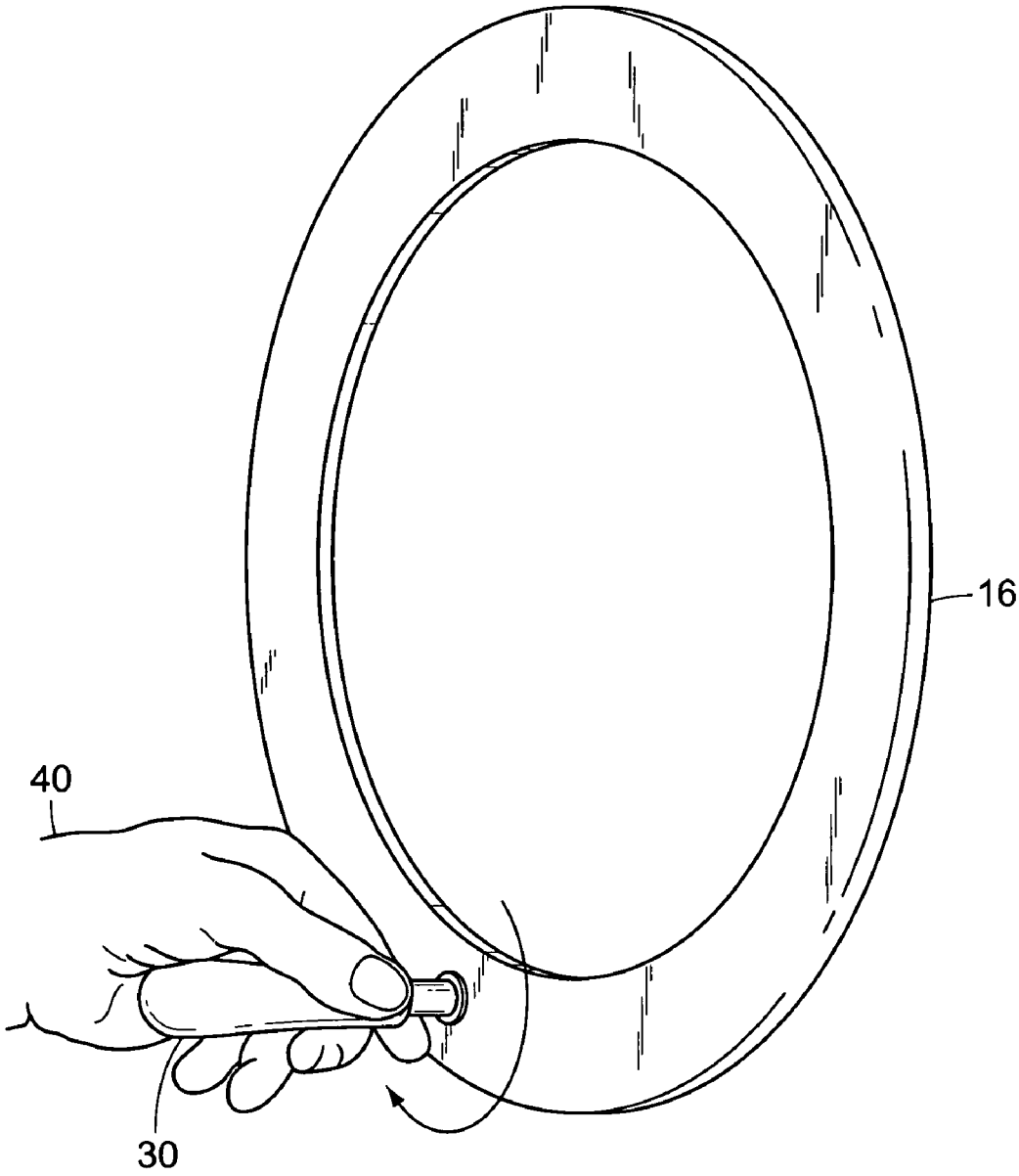
FIG. 3 is a perspective view of the present invention illustrated in use.

FIG. 3 illustrates the present invention in use. The user would grasp the handle portion 30 within one hand 40. The user would then turn the handle portion 30 in a clockwise direction causing the circular ring 10 to spin around, and this motion along with the weight of the circular ring 10 will start to work the muscles in the hand and forearm. As the user rotates the handle portion 30 with his/her hand, the weight of the circular disc will resist such rotation and enhance the muscular workout.

A variety of exercises can be performed with the present invention. In particular, the handle portion 30 can be held either horizontally or vertically. In addition, while holding the handle portion 30 the user can hold his/her arms in numerous positions to isolate different muscles and provide exercise variety.

Generally, two tools 10 are used simultaneously, such that the user hold the handle portion 30 of each of said tools 10 within one of the hands. This allows exercises to be performed with hold hands at the same time. In particular, the user rotates each of the handles with one of the hands while the weight of the rotation is resisted by the weight of the disk.

Figure 4:
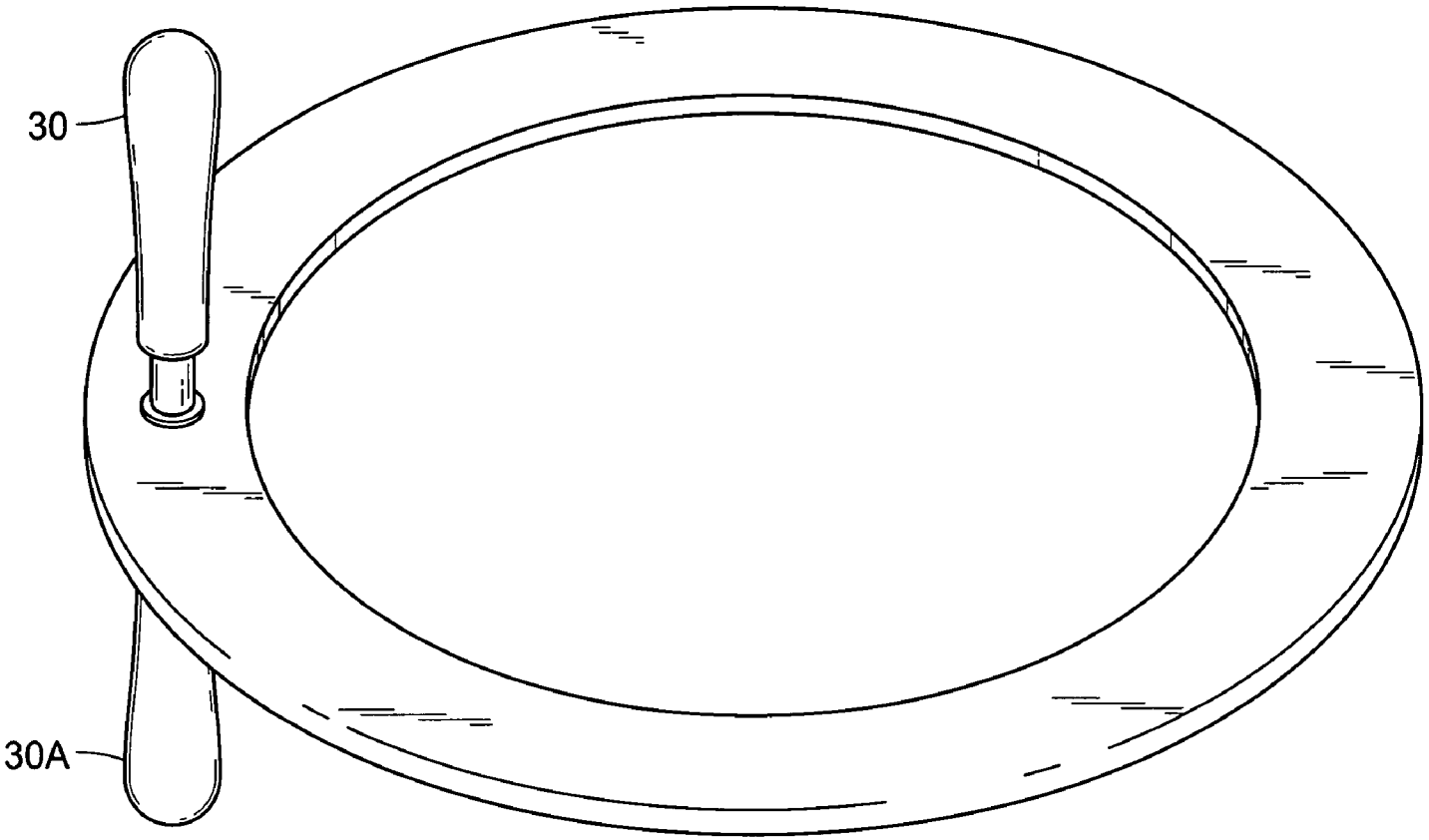
FIG. 4 is a perspective view of an alternate embodiment of the present invention.

FIG. 4 illustrates an alternate embodiment of the present invention utilizing an additional handle portion 30A. The two handle portions 30, 30A allow a user to exercise both hands and forearms simultaneously using a single tool 10. In particular, one handle portion 30 protrudes perpendicularly from the upper surface 12 while the other handle portion 30A protrudes perpendicularly from the lower surface 14. The two handles extend substantially coaxially, and may be grasped in various ways to perform numerous additional exercises.

In conclusion, herein is presented a muscle building tool for providing an effective upper body workout. The invention is illustrated by example in the drawing figures, and throughout the written description. It should be understood that numerous variations are possible, while adhering to the inventive concept. Such variations are contemplated as being a part of the present invention.

What is claimed is:

1. A muscle building tool for providing an effective upper body workout, comprising:

a circular ring having a planar upper surface and a planar lower surface, the circular ring having an inner edge and an outer edge, the circular ring having an aperture therethrough intermediate the inner edge and outer edge thereof, the aperture having an internally threaded nut extending within the aperture from the lower surface;

a handle portion rotatably coupling with the circular ring, the handle portion having an enlarged gripping portion and a neck, the gripping portion and the neck being separated by a flange, the neck being externally threaded, the neck extending through the aperture in the circular ring and coupling with the internally threaded nut with the flange resting upon the upper surface of the ring; and further comprising another handle portion that extends perpendicularly from the lower surface, such that both handle portions are coaxial.

* * * * *